US008437220B2

(12) United States Patent
Camwell et al.

(10) Patent No.: US 8,437,220 B2
(45) Date of Patent: May 7, 2013

(54) PARALLEL-PATH ACOUSTIC TELEMETRY ISOLATION SYSTEM AND METHOD

(75) Inventors: Paul L. Camwell, Calgary (CA); David D. Whalen, Calgary (CA); Douglas S. Drumheller, Cedar Crest, NM (US)

(73) Assignee: Xact Downhold Telemetry, Inc., Calgary, Alberta (CA)

( * ) Notice: Subject to any disclaimer, the term of this patent is extended or adjusted under 35 U.S.C. 154(b) by 752 days.

(21) Appl. No.: 12/697,938

(22) Filed: Feb. 1, 2010

(65) Prior Publication Data

US 2010/0195441 A1 Aug. 5, 2010

Related U.S. Application Data

(60) Provisional application No. 61/148,995, filed on Feb. 1, 2009.

(51) Int. Cl.
*E21B 47/16* (2006.01)

(52) U.S. Cl.
USPC ..... 367/81; 367/82; 340/853.1; 340/856.3; 340/856.4

(58) Field of Classification Search ..... 367/81, 367/82; 340/853.1, 856.3, 856.4
See application file for complete search history.

(56) References Cited

U.S. PATENT DOCUMENTS

| | | | | |
|---|---|---|---|---|
| 3,268,859 | A * | 8/1966 | Watts | 367/36 |
| 3,529,682 | A * | 9/1970 | Coyne et al. | 175/45 |
| 3,828,867 | A | 8/1974 | Elwood | |
| 3,876,016 | A | 4/1975 | Stinson | |
| 3,979,724 | A | 9/1976 | Silverman et al. | |

(Continued)

FOREIGN PATENT DOCUMENTS

| | | |
|---|---|---|
| CA | 2569818 | 6/2007 |
| EP | 0033192 | 8/1981 |
| WO | WO-2009146548 | 12/2009 |

OTHER PUBLICATIONS

Drumheller, Douglas S., "Wave Impedances of Drill Stings and Other Periodic Media", *The Journal of the Acoustical Society of America*, vol. 112, No. 6 (Dec. 2002),pp. 2527-2539.

(Continued)

*Primary Examiner* — Albert Wong
*Assistant Examiner* — Amine Benlagsir
(74) *Attorney, Agent, or Firm* — Law Office of Mark Brown, LLC; Mark E. Brown

(57) ABSTRACT

An acoustic telemetry isolation system and method for use with tubular assemblies such as drillpipe and production tubing includes an acoustic wave transmitter and an acoustic isolator. A "down" wave propagated toward the isolator is reflected back substantially in phase with an "up" wave propagated from the acoustic wave source away from the isolator. Furthermore, the acoustic isolator is similarly effective in reflecting "up" propagating waves originating from below the isolator, hence further protecting the acoustic wave source from possible deleterious interference. The construction of the isolator utilizes a specified combination of waves traveling in parallel in materials whose properties aid the beneficial combination of reflected and transmitted waves. The design of the isolator is to generally provide a bandstop filter function, thereby aiding the frequency isolation of an acoustic transmitter over a passband that may be constrained by the geometry of drill pipe or components of production tubing. It causes substantially all of the emitted wave energy to travel in a chosen direction along the drill pipe, thus aiding the efficiency of acoustic telemetry in the pipe.

21 Claims, 12 Drawing Sheets

U.S. PATENT DOCUMENTS

| | | | | |
|---|---|---|---|---|
| 4,021,773 | A | 5/1977 | Keenan | |
| 4,984,289 | A * | 1/1991 | Arakawa et al. | 405/184 |
| 5,070,462 | A | 12/1991 | Chau | |
| 5,128,901 | A | 7/1992 | Drumheller | |
| 5,160,925 | A | 11/1992 | Dailey et al. | |
| 5,477,505 | A | 12/1995 | Drumheller | |
| 5,720,354 | A * | 2/1998 | Stump et al. | 175/26 |
| 6,161,630 | A | 12/2000 | Stump et al. | |
| 6,177,882 | B1 | 1/2001 | Riggenberg et al. | |
| 6,250,402 | B1 | 6/2001 | Brune et al. | |
| 6,320,820 | B1 | 11/2001 | Gardner et al. | |
| 6,435,286 | B1 | 8/2002 | Stump et al. | |
| 6,535,458 | B2 * | 3/2003 | Meehan | 367/81 |
| 6,791,474 | B2 | 9/2004 | Lenz et al. | |
| 6,920,943 | B2 | 7/2005 | Mercer et al. | |
| 6,956,791 | B2 | 10/2005 | Dopf et al. | |
| 6,968,909 | B2 | 11/2005 | Aldred et al. | |
| 7,228,900 | B2 | 6/2007 | Schultz et al. | |
| 7,663,373 | B1 * | 2/2010 | Gard et al. | 324/346 |
| 2002/0031050 | A1 * | 3/2002 | Blevins et al. | 367/127 |
| 2003/0006071 | A1 * | 1/2003 | Stump et al. | 175/61 |
| 2003/0076106 | A1 * | 4/2003 | Mercer | 324/326 |
| 2006/0131014 | A1 * | 6/2006 | Huang et al. | 166/250.07 |
| 2007/0039776 | A1 * | 2/2007 | Clark | 181/110 |
| 2007/0153629 | A1 * | 7/2007 | Drumheller et al. | 367/162 |
| 2007/0257809 | A1 | 11/2007 | Camwell et al. | |
| 2011/0100712 | A1 | 5/2011 | Poedjono | |

OTHER PUBLICATIONS

"International Search Report and Written Opinion for PCT/US2011/032532", (Jun. 30, 2011).

"Schlumberger Oilfield Glossary entry for "bottomhole assembly"", www.glossary.oilfield.slb.com, accessed Feb. 22, 2012.

Drumheller, Douglas S., "Acoustical Properties of Drill Strings", *J. Acoust. Soc. Am.*, (Mar. 1989),85(3).

Young, Warren C., et al., "Roark's Formulas for Stress and Strain", *Case 1, 7th Edition, McGraw-Hill*, (Sep. 13, 2001),p. 592, Section 13.8 Tables, Table 13.1.

Lapeyrouse, Norton J., "Formulas and Calculations for Drilling, Production and Workover", *2nd edition, 2002, Gulf Professional Publishing, an imprint of Elsevier Science*, (2002), p. 6.

Grover, Wayne D., et al., "Development and Performance Assessment of a Distributed Asynchoronous Protocol for Real-Time Network Restoration", *IEEE Journal on Selected Areas in Communications*, (Jan. 1991),9(1): 112-125.

Besaisow, A. A, et al., "Development of a Surface Drillstring Vibration Measurement System", *60th Annual Technical Conference and Exhibition of the Society of Petroleum Engineers*, Las Vegas, NV, (Sep. 22, 1985),pp. 1-14.

Besaisow, A. A., et al., "Application of ADAMS (Advanced Drillstring Analysis and Measurement System) and Improved Drilling Performance", *IADC/SPE Drilling Conference*, Houston, TX, (Feb. 27, 1990),pp. 717-722.

Barnes, et al., "Passband for Acoustic Transmisssion . . . Drill String", *Journal Acout. Soc.of Amer.*, vol. 51, #5, (1972), pp. 1606-1608.

Squire, et al., "A new Approach to Drill-String Acoustic Telemetry", *SPE of AIME, SPE 8340*, (Sep. 1979).

Drumheller, Douglas S., "Wave Impedances of Drill Strings and Other Periodic Media", *J. Acoustical Society of America*, vol. 112, issue 6, (2002),2527-2539.

* cited by examiner

PARALLEL-PATH ACOUSTIC TELEMETRY ISOLATION SYSTEM AND METHOD

CROSS-REFERENCE TO RELATED APPLICATIONS

This application claims priority in U.S. Provisional Patent Application No. 61/148,995, filed Feb. 1, 2009, which is incorporated herein by reference.

BACKGROUND OF THE INVENTION

1. Field of the Invention

The present invention relates generally to telemetry apparatus and methods, and more particularly to acoustic telemetry isolation apparatus and methods for the well drilling and production (e.g., oil and gas) industry.

2. Description of the Related Art

Acoustic telemetry is a method of communication used, for example, in the well drilling and production industry. In a typical drilling environment, acoustic extensional carrier waves from an acoustic telemetry device are modulated in order to carry information via the drillpipe as the transmission medium to the surface. Upon arrival at the surface, the waves are detected, decoded and displayed in order that drillers, geologists and others helping steer or control the well are provided with drilling and formation data. In production wells, downhole information can similarly be transmitted via the well production tubing.

The theory of acoustic telemetry as applied to communication along drillstrings has a long history, and a comprehensive theoretical understanding has generally been backed up by accurate measurements. It is now generally recognized that the nearly regular periodic structure of drillpipe imposes a passband/stopband structure on the frequency response, similar to that of a comb filter. Dispersion, phase non-linearity and frequency-dependent attenuation make drillpipe a challenging medium for telemetry, the situation being made even more challenging by the significant surface and downhole noise generally experienced.

The design of acoustic systems for static production wells has been reasonably successful as each system can be modified within economic constraints to suit these relatively long-lived applications. The application of acoustic telemetry in the plethora of individually differing real-time drilling situations, however, presents other challenges and this is primarily due to the increased noise due to drilling and the problem of unwanted acoustic wave reflections associated with downhole components, such as the bottom-hole assembly (or "BHA"), typically attached to the end of the drillstring, which reflections can interfere with the desired acoustic telemetry signal. The problem of communication through drillpipe is further complicated by the fact that drillpipe has heavier tool joints than production tubing, resulting in broader stopbands; this entails relatively less available acoustic passband spectrum, making the problems of noise and signal distortion relatively more severe.

To make the situation even more challenging, BHA components are normally designed without any regard to acoustic telemetry applications, enhancing the risk of unwanted and possibly deleterious reflections caused primarily by the BHA components.

When exploring for oil or gas, in coal mine drilling and in other drilling applications, an acoustic transmitter is preferentially placed near the BHA, typically near the drill bit where the transmitter can gather certain drilling and geological formation data, process this data, and then convert the data into a signal to be transmitted up-hole to an appropriate receiving and decoding station. In some systems the transmitter is designed to produce elastic extensional stress waves that propagate through the drillstring to the surface, where the waves are detected by sensors such as accelerometers, attached to the drill string or associated drilling rig equipment. These waves carry information of value to the drillers and others who are responsible for steering the well. Examples of such systems and their components are shown in: Drumheller U.S. Pat. No. 5,128,901 for Acoustic Data Transmission through a Drillstring; Drumheller U.S. Pat. No. 6,791,474 for Reducing Injection Loss in Drill Strings; Camwell et al. U.S. Patent Publication No. 2007/0258326 for Telemetry Wave Detection Apparatus and Method; and Camwell et al. U.S. Patent Publication No. 2008/0253228 for Drill String Telemetry Methods and Apparatus. These patents and publications include common inventors with the present application and are incorporated herein by reference.

Exploration drilling in particular has become a highly evolved art, wherein the specification and placement of the BHA components is almost entirely dictated by the driller's need to drill as quickly and accurately as possible while gathering information local to the drill bit. A large variety of specialized BHA modules or tools are available to suit local conditions, and their inclusion in a BHA usually takes priority over the requirements of telemetry methods, acoustic or otherwise. The diversity of these BHA tools and the decision regarding whether or not to even include them in a drillstring, pose major issues for consideration; these issues have a significant impact when dealing with acoustic energy questions. Cyclic acoustic waves suffer multiple reflections and amplitude changes even in a very simple BHA, and the net effect of these changes may destructively interfere with the required acoustic telemetry broadcast signal. The reflections are caused by impedance mismatches which are the result of mechanical discontinuities present in all BHAs presently in use.

An initial response to this problem would be to place the acoustic telemetry device above the BHA and simply direct the acoustic energy up the drillstring, away from the BHA components. Unfortunately, this does not fully address the problem because typical acoustic transmitters emit waves of equal magnitude both up-hole and down-hole, and the downward travelling waves in particular may be reflected, thereby potentially resulting in destructive interference with the upward travelling waves. In the worst cases, this can cause virtually complete cancellation of the upward travelling communication signal.

It is known in other fields, for example in radio frequency (RF) transmitter design and electrical transmission lines, that wave reflections can be controlled by inserting simple specific impedance changes at certain distances from a transmitter, such that the combination of the original wave and the reflected wave combine constructively to produce a single wave travelling in one direction with increased amplitude. The standard approach is to insert a "quarter wave" ($\lambda/4$) impedance change (or odd multiples thereof) adjacent to the transmitter so that one wave (the "down" wave) is reflected in phase with the intended transmitted wave (the "up" wave) and constructively aids the intended transmitted wave by increasing its amplitude.

Downhole applications typically employ transmitters that emit stress waves of nearly equal, but not necessarily equal, magnitude in both directions. Moreover, each wave has the same sign in stress but opposite sign in material velocity. In such cases, the appropriate reflection device would be a $\lambda/4$ tuning bar (pipe section) placed below the transmitter. However, such a simple solution is often impractical because the equipment below the acoustic transmitter is designed to drill and steer the well rather than to aid telemetry. Equipment such as drill collars, crossover pipes, drilling motors and bits can easily nullify the benefit of simply introducing a $\lambda/4$ section of pipe below the acoustic transmitter because the equipment will generally be of differing lengths and impedances that can add to the $\lambda/4$ section and eliminate the intended benefit. This discussion assumes the reader is familiar with the phase change differences associated with waves passing from a given medium to that of greater or less acoustic impedance.

Other styles of transmitters which emit waves in both directions, but by design have different relationships between their stresses and material velocity would require tuning bars of different lengths, not necessarily $\lambda/4$ sections, further complicating the problem.

As mentioned above, downhole noise is also of concern in acoustic telemetry. The problem of downhole noise is addressed to some extent in U.S. Pat. No. 6,535,458 to Meehan, wherein is taught a baffle filter comprising a periodic structure of typically 20 m length interposed above or below the acoustic source; this is intended to cause stopbands over a certain range of frequencies, the position of the baffle being to protect the acoustic transmitter from the sources of the noise from the drill bit and motor. This teaching, however, does not address or anticipate the more serious problem of energy propagating in a "down" direction being reflected in a relatively unattenuated manner back to the transmitter where it may combine in a destructive manner with the energy propagating in an "up" direction, thereby causing possibly significant destruction of the signal intended to reach the surface.

As can now be seen, the required upward travelling acoustic telemetry waves are often interfered with by unwanted reflections from impedance mismatches below the transmitter. The known art of inserting a tuning bar of appropriate length is usually ineffective because the local conditions often necessitate the addition of further BHA components that cause further reflections that can often destructively interfere with the upward travelling wave.

BRIEF SUMMARY OF THE INVENTION

It is an object of the present invention to control wave reflections, in particular, in such a manner as to mitigate the otherwise potentially destructive reflections. Specifically, the present invention comprises an apparatus for placement adjacent to the transmitter, and a method for using same, that will beneficially reflect waves, such that:

A. the apparatus can be configured to be effective over a certain broadcast bandwidth, such that all the desired frequencies in a modulated telemetry signal are significantly and beneficially reflected at known places; and B. the apparatus aids the transmitted wave by adding in phase, providing up to a 3 dB gain in the amplitude of the wave motion amplitude and a 6 dB gain in the wave energy.

An isolator according to the present invention seeks to effectively isolate essentially all down waves from the subsequent (i.e. downhole) BHA components, thus curtailing the possibility of waves that would have entered the BHA and returned with potentially destructive phases. Positioning an isolator according to the present invention below the transmitter can, in effect, make the lower BHA components essentially "acoustically invisible" over a bandwidth useful for acoustic telemetry.

The present invention is also intended to be applicable in situations other than real-time drilling with drillpipe or production wells with production tubing. For example, many relatively shallow wells are drilled with coiled tubing. Although coiled tubing drilling systems do not have the passband/stopband features of drillpipe sections connected by tool joints, they do have BHA components similar to those in jointed pipe applications. Thus, the isolator and the isolation method taught herein are intended to apply equally to the situation of coiled tubing.

It is intended that the present invention be applicable in still further applications. For example, an isolation/reflection means as described herein can also be beneficial in production wells where there may not be a BHA as such, but there may instead be production components such as valves, manifolds, screens, gas lift equipment, etc., below the acoustic source. Thus, the apparatus and method taught herein are intended to apply equally to this situation.

It is not intended that an exhaustive list of all such applications be provided herein for the present invention, as many further applications will be evident to those skilled in the art.

According the present invention, then, there is provided an acoustic isolator for use with tubular assemblies comprising:

a first tubular member of first physical length, first acoustic impedance, and first acoustic transit time;

a second tubular member of second physical length, second acoustic impedance, and of second acoustic transit time;

the first and second members not making contact or exchanging acoustic energy directly to each other;

a first upper coupling placed at the upper end of the first and second members, said coupling restricting the motions of said members and said coupling to be equal at their common points of contact thereby allowing exchange of acoustic energy between the drilling components above said coupling and said tubular members below said coupling;

a second lower coupling placed at the lower end of the first and second members said coupling restricting the motions of said members to be equal at their common points of contact thereby allowing exchange of acoustic energy between the drilling components below said coupling and said tubular members above said coupling;

the lengths, acoustic impedances, and transit times of said tubular members being adjusted so that by means of constructive and destructive wave interference the acoustic energy transmitted through the upper coupling results in reduced motion and force in the lower coupling and likewise acoustic energy transmitted through the lower coupling results in reduced motion and force in the upper coupling.

Thus it is to be understood that downward traveling acoustic energy may be reflected upward, and upward traveling acoustic energy may be reflected downward. Moreover, it is to be understood that acoustic energy could be arriving simultaneously from both directions and the acoustic isolator is simultaneously reflected back towards the drilling components that originally injected the energy.

A detailed description of an exemplary embodiment of the present invention is given in the following. It is to be understood, however, that the invention is not to be construed as limited to this embodiment.

BRIEF DESCRIPTION OF THE DRAWINGS

In the accompanying drawings, which illustrate the principles of the present invention and an exemplary embodiment thereof.

DETAILED DESCRIPTION OF THE PREFERRED EMBODIMENTS

In the following description, reference is made to "up" and "down" waves, but this is merely for convenience and clarity. It is to be understood that the present invention is not to be limited in this manner to conceptually simple applications in acoustic communication from the downhole end of the drillstring to the surface. It will be readily apparent to one skilled in the art that the present invention applies equally, for example, to subsurface stations in drilling applications, such as would be found in telemetry repeaters, or non-drilling applications as would be found in production wells.

Figure 1:
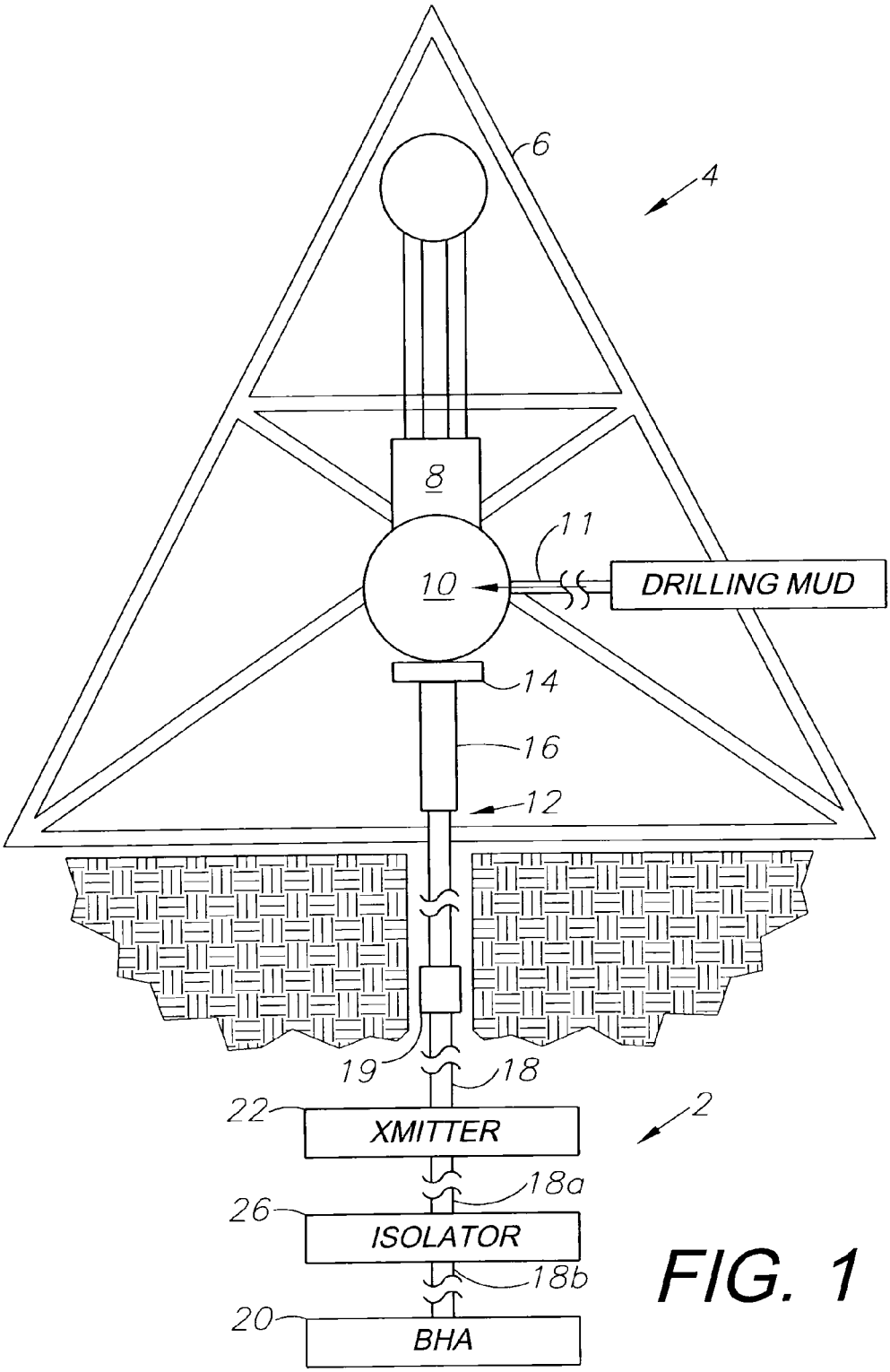
FIG. 1 is a diagram of a typical drilling rig, including an acoustic telemetry isolation system embodying an aspect of the present invention.

Referring to the drawings more detail, the reference numeral 2 generally designates a parallel-path acoustic isolation system embodying an aspect of the present invention. Without limitation on the generality of useful applications of the system 2, an exemplary application is in a drilling rig 4 as shown in a very simplified form in FIG. 1. For example, the rig 4 can include a derrick 6 suspending a traveling block 8 mounting a kelly swivel 10, which receives drilling mud via a kelly hose 11 for pumping downhole into a drillstring 12. The drillstring 12 is rotated by a kelly spinner 14 connected to a kelly pipe 16, which in turn connects to multiple drill pipe sections 18, which are interconnected by tool joints 19, thus forming a drillstring of considerable length, e.g. several kilometers, which can be guided downwardly and/or laterally using well-known techniques. The drillstring 12 terminates at a conventional bottom-hole apparatus (BHA) 20, typically comprising a drill bit, bit sub, mud motor, crossover, non-magnetic drill collar, etc., thence connecting to the drillpipe. FIG. 1 shows acoustic modules (isolator 26 and transmitter 22) as separate from the conventional BHA simply for clarity. Other rig configurations can likewise employ the acoustic isolation system of the present invention, including top-drive, coiled tubing, etc.

Figure 2:
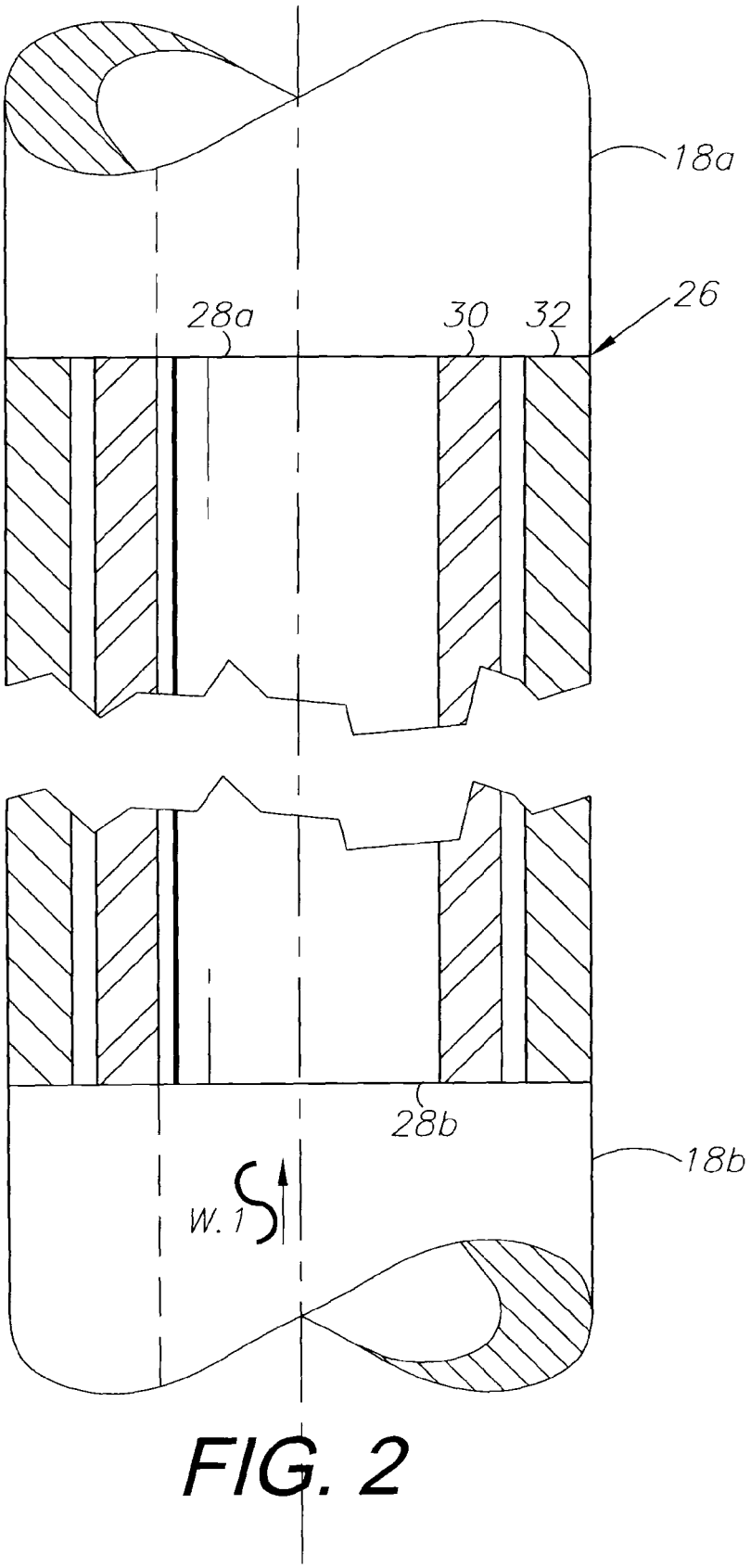
FIG. 2 is a fragmentary, side elevational view of the acoustic telemetry isolation system, particularly showing an isolator thereof.

FIG. 2 shows the components of the acoustic isolation system 26 which is incorporated along the drillstring 12, e.g., just above the BHA 20, or at other desired locations therealong. An upper, adjacent pipe section 18*a* is connected to a parallel-path acoustic isolator 26 at an upper interface 28*a*. The isolator 26 is also connected to a downhole adjacent pipe section 18*b* at a lower interface 28*b*. Without limitation, the isolator 26 can be located below a piezoelectric transducer (PZT) transmitter 22. Examples of such acoustic transducers and their construction are shown in Drumheller U.S. Pat. No. 5,703,836 for Acoustic Transducer and Drumheller U.S. Pat. No. 6,188,647 for Extension Method of Drillstring Component Assembly, which are incorporated herein by reference.

The focus of the present invention is to implement designs of isolators 26 comprising inner and outer tubular, coaxial isolation members 30, 32 (pipes of various types) such that judicious control of their impedances and transient times may result in a useful and necessary apparatus, i.e. the parallel-path acoustic isolator 26 which can be incorporated in the acoustic isolation system 2.

First, it should be understood that the wave speed c and characteristic acoustic impedance z of a pipe section i of uniform material properties and wall area are:

$$c_i=\sqrt{E_i/\rho_i} \quad [1]$$

$$z_i=\sqrt{\rho_i E_i}A_i=\rho_i c_i A_i \quad [2]$$

where $\rho_i$=material mass density $E_i$=material stiffness (Young's modulus)

$A_i$=wall area of the pipe

Also note that pipe section i with wave speed $c_i$ and length L has a transit time of $$\Delta t_i=L/c_i \quad [3]$$

Figure 3:
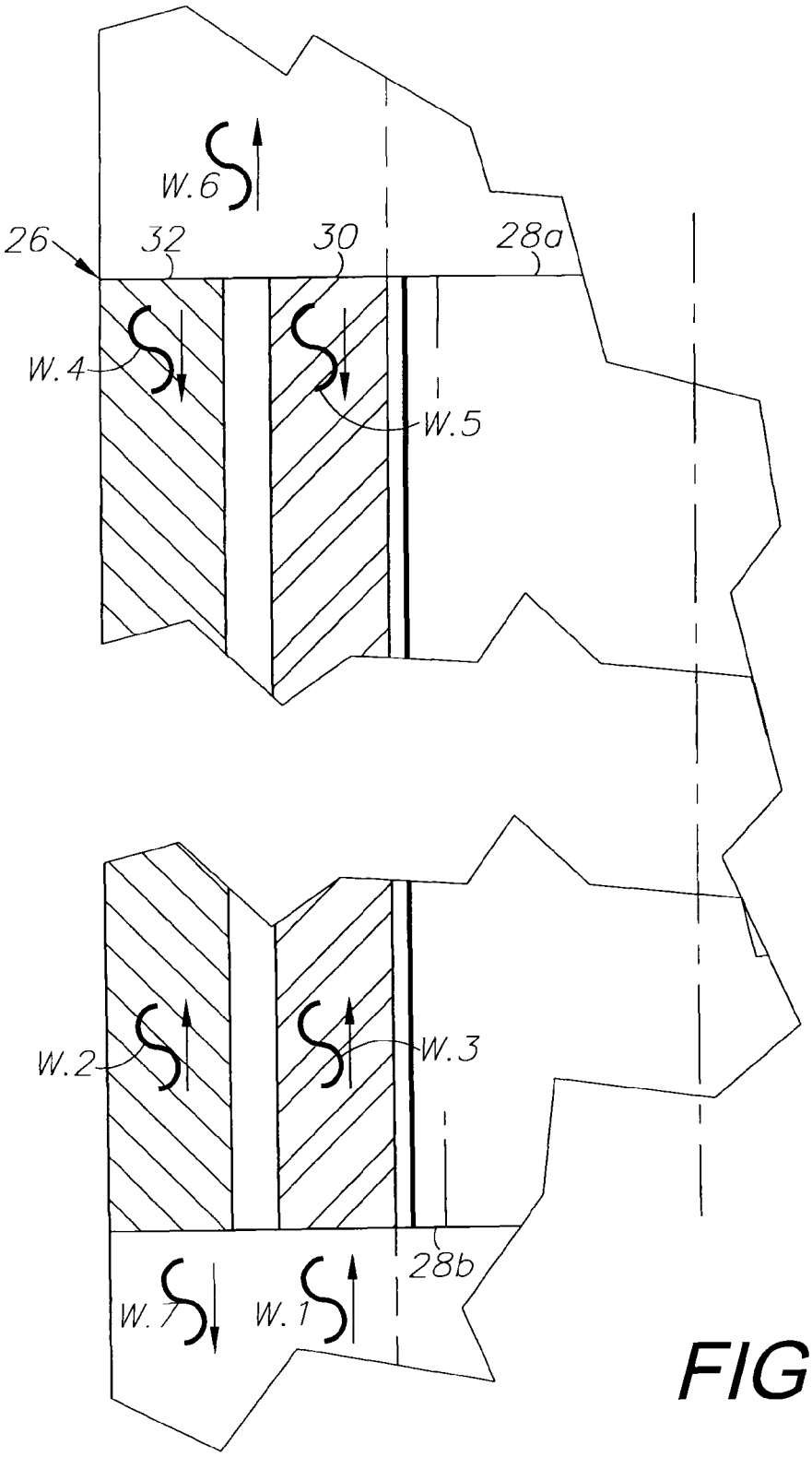
FIG. 3 is a fragmentary, enlarged side elevational view of the isolator, particularly showing the propagation of acoustic energy waves.

The basic principle of operation of this invention can be understood through an examination of an upwardly traveling incident simple wave W.1 (see FIGS. 2, 3). Typically, as this wave encounters the lower interface 28*b* it gives rise to a reflected wave W.1 in pipe section 18 and transmitted waves W.3, W.2 in pipes 30 and 32 respectively. Subsequent interactions of waves W.3 and W.2 with upper interface 28*a* give rise to reflections W.5, W.4 in pipes 30 and 32 respectively as well as a transmitted wave W.6 in upper pipe section 18*a*. As time progresses wave reflections continue at interfaces 28*a* and 28*b*, producing ever more complex modifications of the waves in pipes 30 and 32 as well as additional modifications to the reflected wave W.7 and transmitted wave W.6. When the primary incident wave W.1 is a harmonic wave of frequency f it is possible to analyze these wave interactions and thereby derive the following expression:

$$I=G(f)T \quad [4]$$

where

I=amplitude of material velocity of the incident wave W.1

T=amplitude of material velocity of the transmitted wave W.6

G(f)=transfer function of parallel-path isolator, which is a function of f.

The object of designing an isolator is to make the transmitted amplitude T zero or nearly zero for arbitrary finite values of the amplitude I. This occurs in the neighbourhood of the poles of the transfer function G(f). The locations of the poles are given by:

$$z_2(1-P_1^2)P_2+z_1(1-P_2^2)P_1=0 \quad [5]$$

where $$P_i=\exp(ik_iL) \quad [6]$$

Controlling the locations of the roots of [5] is key to designing an isolator, and this is best achieved by examining the function $$S(f)=|z_2(1-P_1^2)P_2+z_1(1-P_2^2)P_1| \quad [7]$$

which will be referred to as the pole equation. A plot of this equation reveals the frequencies $f_r$ where $S(f_r)=0$. These frequencies are the solutions of [5]. Another simplified expression yields the solution for the reflected wave W.7 at the root frequencies $f_r$:

$$R = \frac{1+K(f_r)}{1-K(f_r)}I \quad [7a]$$

$$K(f) = \frac{z_2(1+P_2)}{z_4(1-P_2)} + \frac{z_1(1+P_1)}{z_4(1-P_1)} \quad [7b]$$

where R=amplitude of wave W.7.

It is now instructive to examine a special case of [5] in which both the pipes 30 and 32 have the same impedance. Indeed for $z_1=z_2$ equation [5] yields:

$$(P_1+P_2)(1-P_1P_2)=0. \quad [8]$$

The roots of [8] are obviously:

$$P_1=-P_2 \quad [9]$$

$$P_1P_2=1. \quad [10]$$

Substitution of [6] in these expressions yields the following frequency pairs $$f_r = \frac{2n+1}{2L|1/c_1-1/c_2|} \quad [11]$$

$$f_r = \frac{n+1}{L(1/c_1+1/c_2)} \quad [12]$$

where n is an arbitrary integer including zero, and

L=length of pipes 30 and 32

Each value of n yields a pair of frequencies from [11] and [12]. The pair of frequencies obtained for n=0 are of particular use. Solving this specific pair of frequencies for L yields:

$$L = \frac{1}{2f_r|1/c_1-1/c_2|} \quad [13]$$

$$L = \frac{1}{f_r(1/c_1+1/c_2)} \quad [14]$$

Considering an incident wave W.1 whose frequency satisfies [9] will now provide an instructive discussion of the operation of the isolator. Upon initially encountering interface 28*b* a wave of this frequency produces transmitted waves W.2, W.3 in pipes 30 and 32 respectively. Waves W.2 and W.3 are in phase as they leave interface 28*b*, and because $z_1=z_2$ their forces and material velocities are equal. However, each wave travels at a different velocity upwardly towards interface 28*a*.

Because the frequency satisfies [9], waves W.2 and W.3 are caused to arrive at interface 28*a* with values of force and velocity that are opposite in sign to each other. Thus the total force and motion exerted by pipes 30 and 32 on interface 28*a* is ideally at or near zero, and little or no transmitted wave W.6 is produced in pipe segment 18*a*.

Parallel path isolators 26 can be designed from these expressions. The following examples illustrate how.

EXAMPLE 1

Table 1 contains material specifications and dimensions for pipes 30 and 32 of a parallel-path isolator. The sizes would be compatible with typical 6.5" oilfield drilling tools. Notice that both pipes are chosen such that they have the same characteristic impedance z. The center frequency of the required isolation band is specified to be 660 Hz.

TABLE 1

| Material | Pipe 30 (Lead) | Pipe 32 (Stainless steel) |
|---|---|---|
| OD (in) | 5.7 | 6.5 |
| ID (in) | 2.5 | 5.76 |
| A ($m^2$) | 0.009 | 0.0046 |
| ρ ($Mg/m^3$) | 11200 | 7760 |
| E (GPa) | 15.8 | 191 |
| c (m/s) | 1188 | 4961 |
| z (Mg/s) | 177 | 177 |

We are now able to employ solutions to [13] and [14]. They yield the following values for the length of pipes 30 and 32 respectively:

L=1.18 m (pipe 30)

L=1.45 m (pipe 32)

Setting the length of the isolator to the average of these two values (L=1.32 m) will center the pair of poles about 660 Hz.

Figure 4:
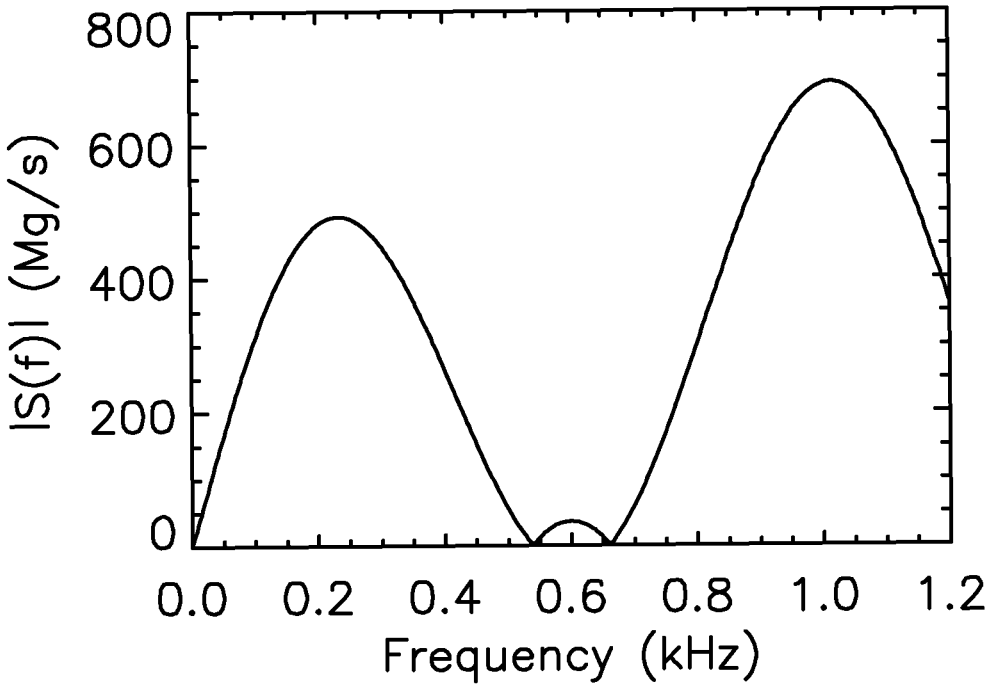
FIG. 4 is a plot of a pole equation over a frequency range from 0 to 1200 Hz.

FIG. 4 is a plot of the pole equation [7] over the range of frequencies from 0 to 1200 Hz. The zero points at 590 Hz and 730 Hz are the frequencies given by [13] and [14]. Notice that the two poles are centered about the desired frequency: 660 Hz.

Figure 5:
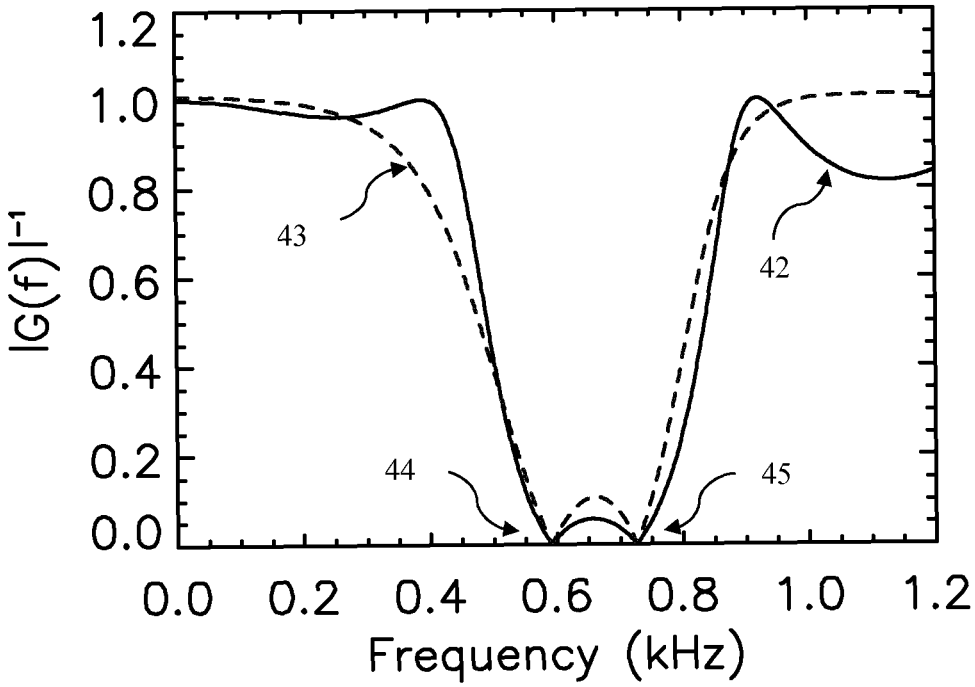
FIG. 5 is a plot of a transfer function for different acoustic impedance values for the drillpipe sections and FIG. 6 is a corresponding plot of the pole equation.

The harmonic analysis using equation [4] is shown in FIG. 5, illustrating the magnitude |T| of wave W.6 due to an incident wave W.1 of unit magnitude |I|=1 is provided by $|T|=|G(f)|^{-1}$.

Note that at the frequencies corresponding to the zero points, 590 Hz and 730 Hz, there is no transmitted wave because $|T|=|G(f)|^{-1}=0$ at these frequencies. However, if the frequency of the wave is unequal to either of the two pole frequencies it will not be completely reflected by the isolator, and some wave energy will enter pipe 18*a*.

In FIG. 5 the transfer function is determined for two cases. In the first case the acoustic impedances of pipe segments 18*b* and 18*a* are 700 Mg/s. In the second case they are 354 Mg/s. Note that this latter case represents an impedance match to the parallel-path isolator as $z_3=z_4=z_1+z_2$. FIG. 5 shows the amplitude of the wave that passes through the isolator to pipe 18*a* from pipe segment 18*b*. Curve 43 represents the response for the matched impedances of 354 Mg/s. Curve 42 represents the response when pipe segments 18*a* and 18*b* have impedances of 700 Mg/s. For an ineffective isolator these curves would be flat with constant amplitude of 1. Indeed both curves again confirm that waves with the pole frequencies of 590 and 730 Hz are completely blocked by the isolator 26 (see points 44 and 45 in FIG. 5) and in the passband between these two frequencies the isolator remains effective.

Note the similarity in the plots of the pole equation [7] in FIG. 4 and the plots of the transmitted amplitude T in FIG. 5, particularly in the neighbourhood around and between the pole frequencies themselves. This is particularly useful in the design of an isolator due to the simplicity of the pole equation.

Figure 6:
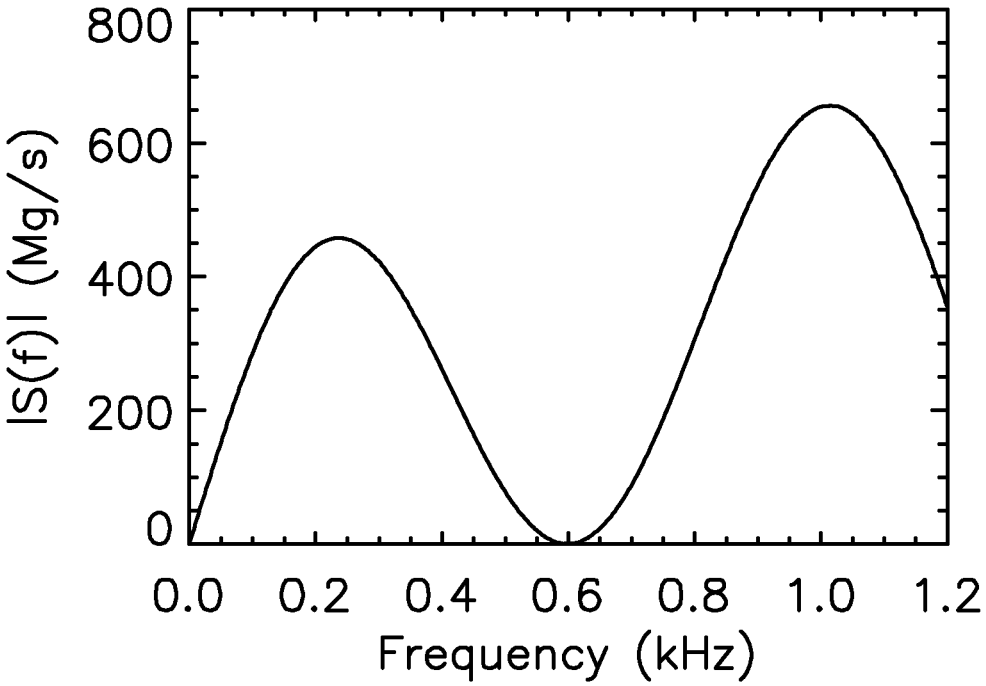
Figure 7:
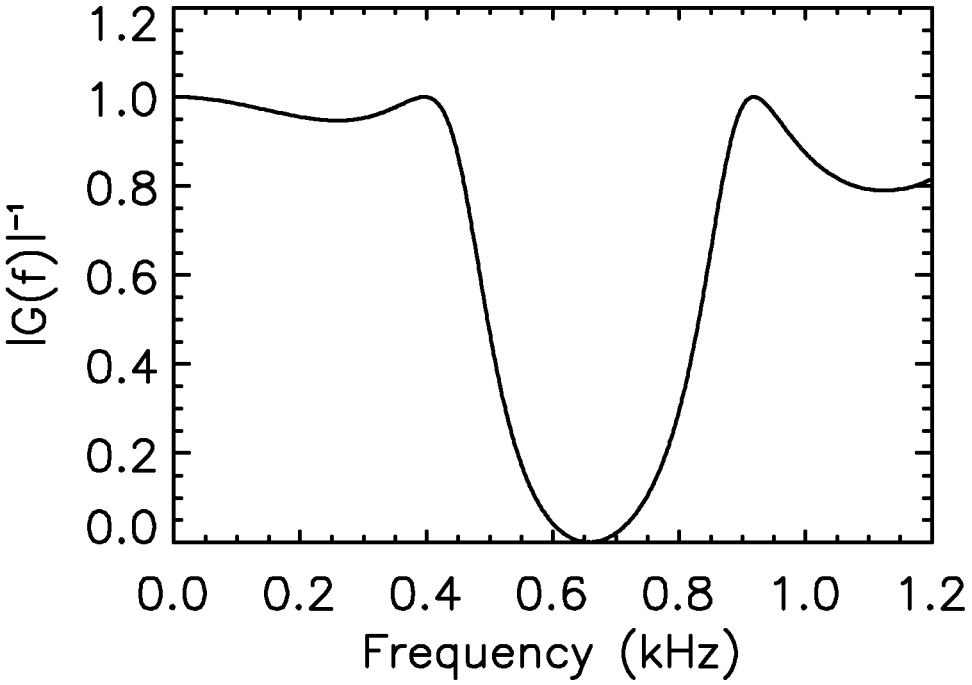
FIG. 7 shows the results for the transmitted wave amplitudes obtained from harmonic analysis.

The pole equation also has another interesting feature. To illustrate this, suppose the impedance of pipe 32 is reduced from 177 Mg/s to 159 Mg/s. FIG. 6 is the corresponding plot of the pole equation. Note the two pole frequencies have merged to form a tangent point at the center frequency: 660 Hz, thereby improving the bandwidth of total isolation. This is evident in FIG. 7 which contains the results for the transmitted wave amplitudes obtained from harmonic analysis.

EXAMPLE 2

Figure 8:
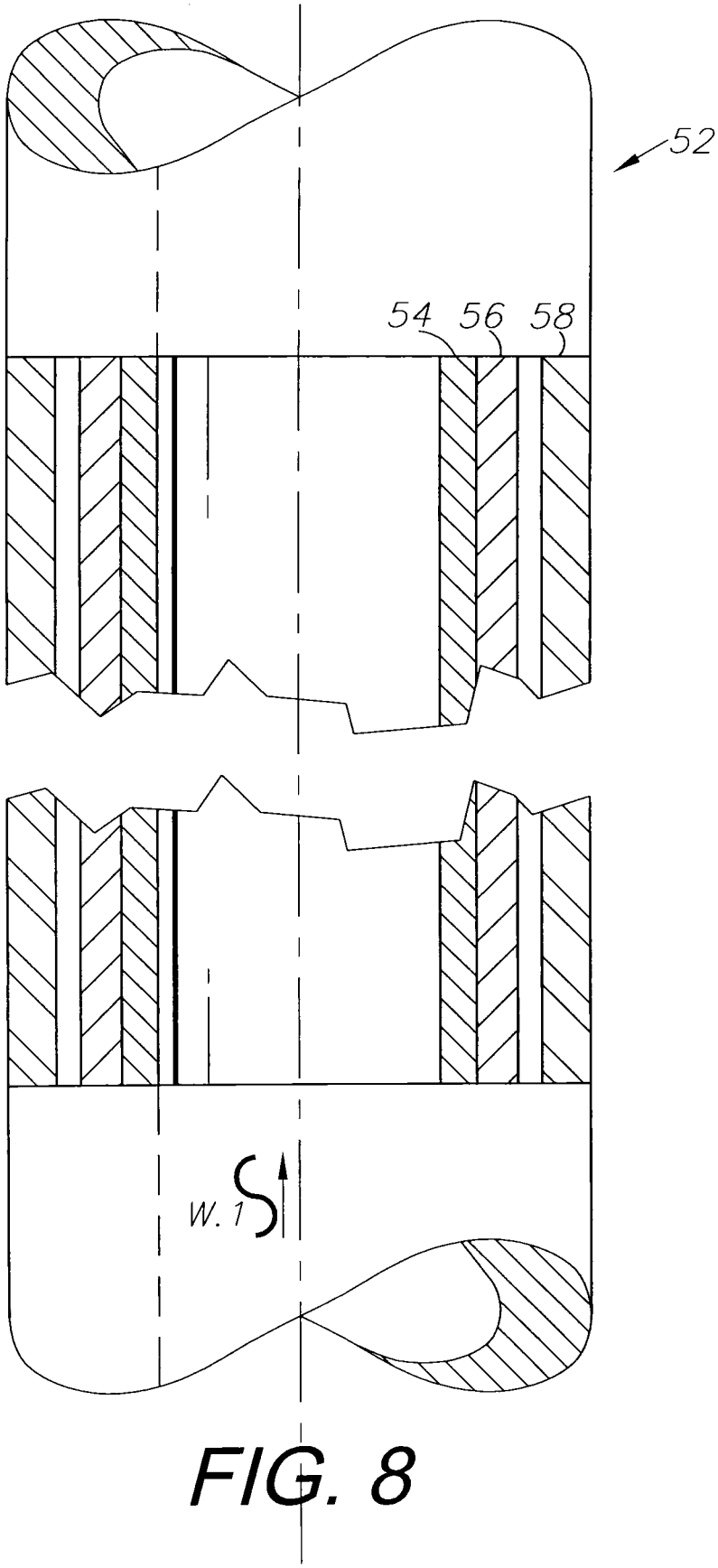
FIG. 8 is a fragmentary, side elevational view of an isolator comprising a first modified aspect of the invention with an inner mandrel of beryllium copper.

FIG. 8 shows an isolator 52 comprising an alternative aspect of the present invention with an inner mandrel 54 of beryllium copper (BeCu). The isolator 52 is otherwise similar to the isolator 26 of Example 1. It is then necessary to increase the inner diameter of an inner pipe 56 to allow room for the modified mandrel. The lead could be attached directly to the mandrel 54 to form a composite structure that functions similarly to inner pipe 30 of the first isolator 26 discussed above. In this new isolator 52 the lead of the inner pipe 30 can be replaced by another material, such as "High Gravity" particle-filled nylon in the inner pipe 56, which can be molded to the features on the mandrel 54. The properties of these materials are listed in Table 2 below:

TABLE 2

| Material | High Gravity Nylon | BeCu | Composite (HG Nylon + BeCu) | Stainless Steel |
|---|---|---|---|---|
| OD (in) | 5.45 | 3.4 | 5.45 | 6.5 |
| ID (in) | 3.4 | 2.5 | 2.5 | 5.76 |
| A ($m^2$) | 0.0092 | 0.0027 | 0.0119 | 0.0046 |
| ρ ($kg/m^3$) | 8000 | 8370 | 8083 | 7760 |
| E (GPa) | 11.7 | 131 | 38.7 | 191 |
| c (m/s) | 1209 | 3956 | 2188 | 4961 |
| z (Mg/s) | 88.9 | 89.1 | 210 | 177 |

The column labelled Composite contains the averaged properties of the High Gravity/BeCu composite pipe 54/56, which also includes the averaged density and the parallel-coupled stiffness. The composite wave speed and impedance are computed from [1] and [2] using the listed composite values of stiffness, density and area. The isolator 52 is constructed of the mandrel 54 and the inner pipe 56 with the properties listed in the composite column and an outer pipe 58 (tubular member) with properties listed in the Stainless Steel column of Table 2. The length L of this isolator is 2.65 m.

Figure 9:
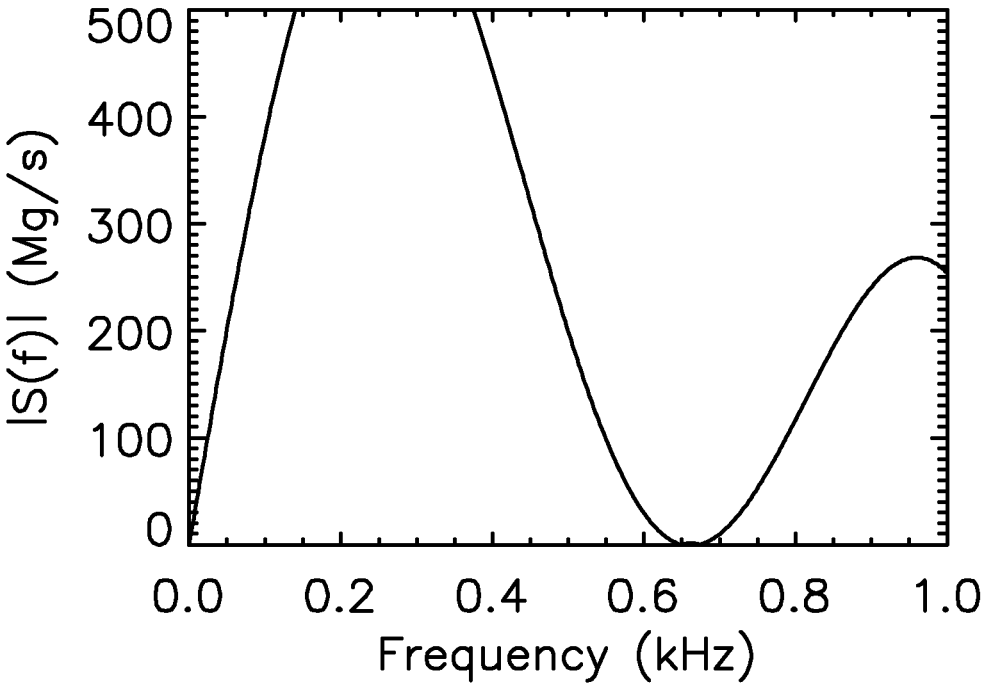
FIG. 9 is a plot of a pole equation therefore over a frequency range from 0 to 1000 Hz.
Figure 10:
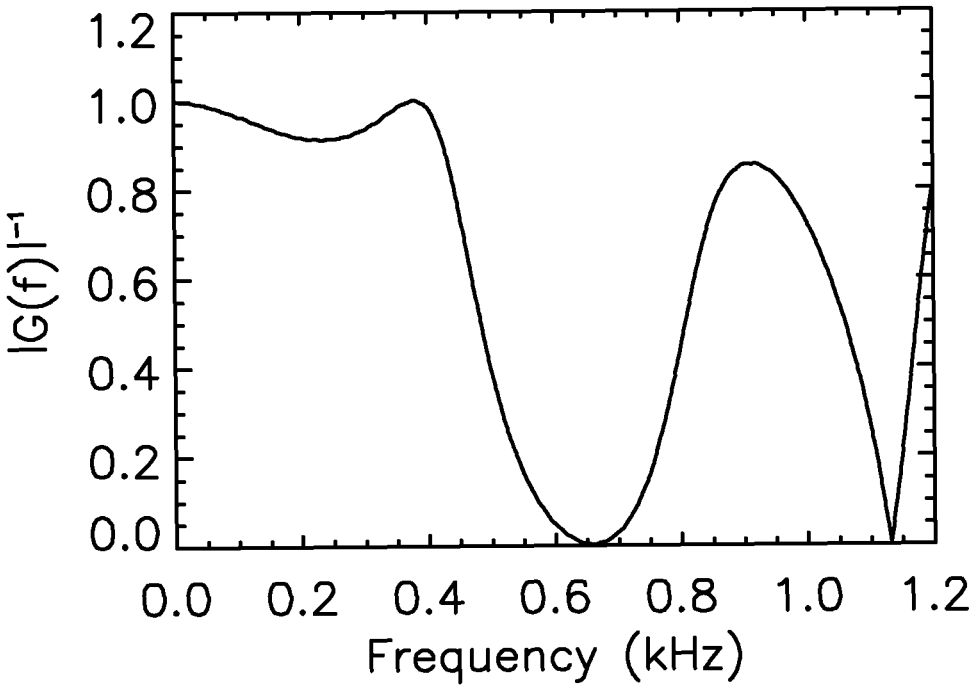
FIG. 10 is a plot of the transfer function therefor.

This length as well as the outside diameter of the High Gravity Nylon inner pipe 56 is determined by iteration of parameters in the pole equation [7] until the plot in FIG. 9 is obtained. The outside diameter of the High Density Nylon inner pipe 56 is adjusted to achieve convergence of the poles, and the length is adjusted to place the center isolation frequency at 660 Hz. The transfer function of this isolator is shown in FIG. 10.

EXAMPLE 3

Figure 11:
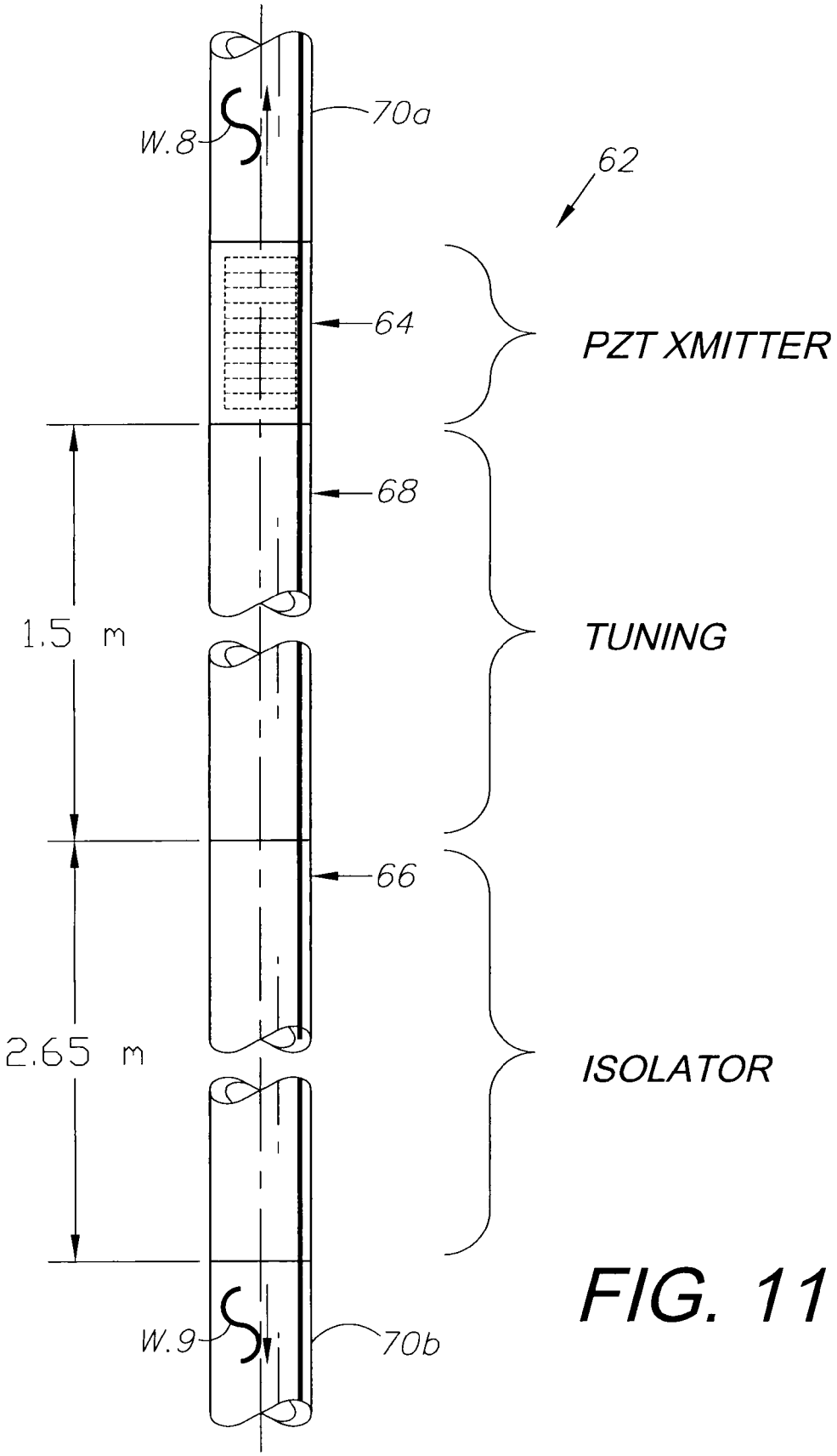
FIG. 11 is a side elevational of a portion of a drillstring with an acoustic isolation system comprising another modified aspect of the present invention with a tuning pipe section.

FIG. 11 shows an acoustic energy isolation system 62 comprising another alternative aspect of the present invention with a piezoelectric transducer (PZT) transmitter 64, which is adapted for use with an isolator 66, which can be constructed similarly to the isolators 26 and 52 described above. Tuning a transmitter is another important use of an isolator. To illustrate how this can be accomplished consider the isolator 66 and the PZT transmitter 64 attached to each other with a tuning pipe 68. The isolator 66 is defined as in Example 2. The assembly of 64, 66 and 68 is bounded by two semi-finite pipe sections 70*a* and 70*b*, located respectively above and below 64, 66. The transmitter 64, bounding pipes 70*a* and 70*b* and the tuning pipe 68 all have impedances of $z_4$=700 Mg/s. A harmonic voltage is applied to the PZT transmitter 64 of sufficient amplitude to cause it to emit upwardly and downwardly traveling waves in pipes 70*a* and 68 respectively. These waves have unit amplitude when measured with respect to their material velocity. Note that when the frequency of the waves is 660 Hz the isolator 66 will reflect the downwardly traveling wave and cause it to combine with the upwardly traveling wave to form a combined wave W.8. Depending on the physical length of the isolator 66 this combination will either be constructive or destructive producing amplitudes in wave W.8 that may range between 0 and 2. It is desired to adjust the length of the isolator 66 to a value that yields an amplitude of approximately 2 for wave W.8. It is known that the two original waves emitted by the PZT transducer are out of phase by π radians. Thus if the downwardly traveling wave is delayed by another π radians (i.e. net 2π radians) before it is combined with the upwardly traveling wave they will combine constructively. Before combining with the upwardly traveling wave, this wave must travel down the tuning pipe 68, undergo reflection by the isolator 66, travel back up pipe 68 and travel up the PZT transmitter 64. Therefore the required length of the tuning pipe 68 is determined as follows:

A phase shift of π radians is achieved when the total delay equals half the period of a 660 Hz wave i.e. 758 μs.

The time for a wave to travel up transmitter 64 is a known property and for this particular example it is 20.5 μs.

For this isolator equation [7a] yields a value of R/I=∠−0.555 radians. This is interpreted as the reflection is equal in amplitude to the downwardly traveling wave but delayed in phase by 0.555 radians. As the period of a 660 Hz wave is 1515 μs the delay due to the isolator reflection is $$1515 = \frac{0.555}{2\pi} = 133.8\ \mu s.$$

The additional delay required for constructive combination is:

$$758-20.5-133.8=603.7\ \mu s.$$

This delay must be achieved by a double transit of the steel tuning pipe 68, which has a known wave speed of 4961 m/s.

Thus the length of the tuning pipe 68 is $$4961 \times \frac{0.0006037}{2} = 1.5\ m.$$

Figure 12:
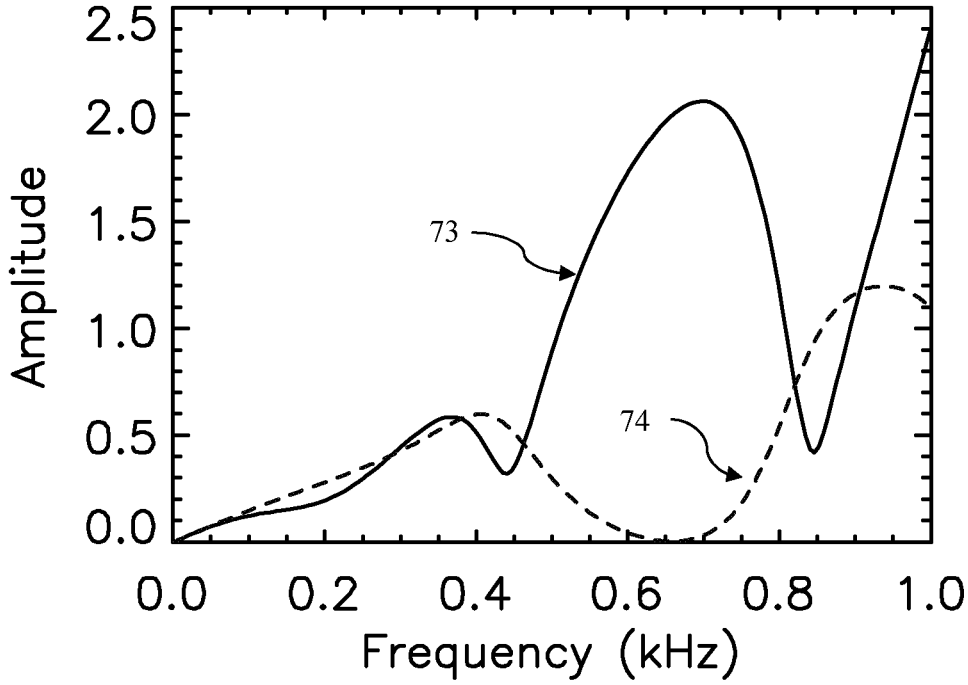
FIG. 12 shows the results for the transmitted wave amplitudes obtained from harmonic analysis.

Using this length for the tuning pipe 68, harmonic analysis of the system yields the amplitude for waves W.8 and W.9. FIG. 12 contains plots of the upwardly traveling wave W.8 (see curve 73) and the downwardly traveling wave W.9 that is able to proceed past the isolator (see curve 74). Note that at 660 Hz the amplitude of curve 73 is 2, and the amplitude of curve 74 is 0, thus a complete constructive combination of the waves occurs at this frequency.

The foregoing explains the innovative method by which an isolator can be built with bandstop properties determined by causing acoustic telemetry waves to travel along specific parallel tubular members such that the ensemble set of reflected and transmitted waves combine with phases that aid unidirectional requirements of an isolating filter.

It is shown how the components of the isolator may be tuned to respond to certain frequency bandpass structures inherent in drillpipe. This enables an acoustic transmitter incorporated in the BHA in a drilling environment to beneficially transmit in a net upward direction, thereby doubling its wave amplitude in that direction.

It is also shown how the components of the isolator may be tuned to respond to certain frequency bandpass structures inherent in downhole production strings, also aiding the transmission of acoustic telemetry signals in a specified direction of benefit to said telemetry.

A notable advance on the previous art is afforded by this invention is to be to provide impressive filter functionality in tubular mechanical materials appropriate to oil and gas drilling and production in a relatively small length considering that the wavelength in drill pipe at 660 Hz is approximately 8 m.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

Having thus described the disclosed subject matter, what is claimed as new and desired to be secured by Letters Patent is:

1. An acoustic isolator for use with tubular assemblies including an acoustic wave transmitter, the acoustic isolator comprising:

a first coaxial tubular member with a first member length including a proximal end and a distal end, a first acoustic impedance and a first acoustic transit time;

a second coaxial tubular member with a second member length including a proximal end and a distal end, a second acoustic impedance and a second acoustic transit time;

said first and second diameters being such that said first member can be placed inside of the second tubular member without making contact with said second tubular member;

the first and second tubular members being aligned so as not to be in physical contact;

a first coupling located at the proximal end of the first and second members, said first coupling restricting the motions of said members and said coupling whereby said motions are approximately equalized at their common points of contact thereby allowing exchange of acoustic energy between the tubular assemblies above said first coupling and said tubular members below said first coupling;

a second coupling placed at the distal end of the first and second members, said second coupling restricting the motions of said members to be equal at their common points of contact thereby allowing exchange of acoustic energy between the tubular assemblies below said second coupling and said tubular members above said second coupling;

the lengths, acoustic impedances, and transit times of said tubular members aligned so that by means of constructive and destructive wave interference the acoustic energy transmitted through the upper coupling results in reduced motion and reduced force in the second coupling, and acoustic energy transmitted through the lower coupling results in reduced motion and force in the first coupling whereby downward traveling acoustic energy is selectively reflected upward and upward traveling acoustic energy is selectively reflected downward;

the first and second coaxial tubular members comprised of different acoustic structure materials, such that acoustic waves originating at the distal end travelling along said coaxial tubular members travel at substantially different wave speeds;

said different acoustic structure materials of equal impedance value; and said differing wave speeds inducing a phase difference between said coaxial tubular members, said phase difference depending on the length of the members.

2. The acoustic isolator of claim 1 including:

the first and second coaxial tubular members each interposed between a pair of couplers located at the proximal and distal ends of said members; and the couplers being adapted for connection to other like collars attached to said tubular assemblies.

3. The acoustic isolator of claim 2, wherein:

the first and second coaxial tubular members are comprised of different acoustic structure materials and are of generally similar length, such that acoustic waves originating at the distal end travelling along said coaxial tubular members travel at substantially different wave speeds;

said different acoustic structure materials of equal impedance value;

said differing wave speeds inducing a phase difference between said coaxial tubular members, said phase difference depending on the length of the members; and upon combining these waves at the proximal end, said phase difference relative from one coaxial tubular member to the other being used to create a filter function used to steer the direction of acoustic waves proximally or distally along said tubular members.

4. The acoustic isolator of claim 2, wherein:

the first and second coaxial tubular members are comprised of different acoustic structure materials and are of generally similar length, such that acoustic waves originating at the distal end travelling along said coaxial tubular members travel at substantially different wave speeds;

said different acoustic structure materials are of approximately equal impedance value;

said differing wave speeds inducing a phase difference between said coaxial tubular members, said phase difference depending on the length of the members; and upon combining these waves at the proximal end, said phase difference relative from one coaxial tubular member to the other being used to create a filter function used to isolate the acoustic transmitter from otherwise deleterious acoustic noise sources.

5. The acoustic isolator of claim 2, which includes:

one of the tubular coaxial members comprising a composite material; and the composite material being capable of slowing the wave speed of an acoustic wave traveling along the member so as to increase the relative phase difference between the two tubular coaxial members.

6. The acoustic isolator of claim 2, wherein:

said first member is lead; and said second member is stainless steel.

7. The acoustic isolator of claim 2, wherein the lengths of the members are adjusted so that the isolation frequency is centered at approximately 660 Hz.

8. The acoustic isolator of claim 2, including:

an internal mandrel of a third diameter, said diameter being less than the diameter of the first tubular coaxial member; and said internal mandrel being located within said first tubular coaxial member.

9. The acoustic isolator of claim 8, wherein the internal mandrel is comprised of beryllium copper.

10. The acoustic isolator of claim 8, wherein the internal mandrel is attached directly to the innermost wall of the first tubular member forming a composite member therewith.

11. The acoustic isolator of claim 8, wherein the first tubular member is comprised of high gravity, particle-filled nylon.

12. The acoustic isolator of claim 2, including:

a piezoelectric transducer transmitter; and said transmitter being adapted for tuning the isolator members to a desired frequency bandpass structure whereby the wave amplitude of the acoustic signal traveling proximally along the members is approximately doubled.

13. An acoustic isolator for use with tubular assemblies including an acoustic wave transmitter, the acoustic isolator comprising:

a first coaxial tubular member with a first member length including a proximal end and a distal end, a first acoustic impedance and a first acoustic transit time;

a second coaxial tubular member with a second member length including a proximal end and a distal end, a second acoustic impedance and a second acoustic transit time;

the first and second tubular members being aligned so as not to be in physical contact;

a first coupling located at the proximal end of the first and second members, said first coupling restricting the motions of said members and said coupling whereby said motions are approximately equalized at their common points of contact thereby allowing exchange of acoustic energy between the tubular assemblies above said first coupling and said tubular members below said first coupling;

a second coupling placed at the distal end of the first and second members, said second coupling restricting the motions of said members to be equal at their common points of contact thereby allowing exchange of acoustic energy between the tubular assemblies below said second coupling and said tubular members above said second coupling;

the lengths, acoustic impedances, and transit times of said tubular members aligned so that by means of constructive and destructive wave interference the acoustic energy transmitted through the upper coupling results in reduced motion and reduced force in the second coupling, and acoustic energy transmitted through the lower coupling results in reduced motion and force in the first coupling whereby downward traveling acoustic energy is selectively reflected upward and upward traveling acoustic energy is selectively reflected downward;

the first and second coaxial tubular members comprised of different acoustic structure materials, such that acoustic waves originating at the distal end travelling along said coaxial tubular members travel at substantially different wave speeds;

said different acoustic structure materials of equal impedance value; and said differing wave speeds inducing a phase difference between said coaxial tubular members, said phase difference depending on the length of the members.

14. The acoustic isolator of claim 13 wherein:

upon combining these waves at the proximal end, said phase difference relative from one coaxial tubular member to the other being used to create a filter function used to steer the direction of acoustic waves proximally or distally along said tubular members.

15. The acoustic isolator of claim 13 wherein:

upon combining these waves at the proximal end, said phase difference relative from one coaxial tubular member to the other being used to create a filter function used to isolate the acoustic transmitter from otherwise deleterious acoustic noise sources.

16. The acoustic isolator of claim 2, wherein:

said first member is lead; and said second member is stainless steel.

17. A method of transmitting acoustic signals in a drill string assembly comprising multiple sections interconnected by couplers and a bottom hole assembly (BHA) at a lower end of the drill string assembly, which method comprises the steps of:

providing a first coaxial tubular member of a first length and including a first diameter, a proximal end and a distal end;

providing a second coaxial tubular member of a second length and including a second diameter, a proximal end and a distal end;

placing said first tubular member inside said second tubular member, wherein the members are not in physical contact, forming an acoustic isolator;

providing a pair of couplers located at the proximal and distal ends of said members, the couplers being adapted for connection to other like collars attached to said drill string assembly sections;

providing a first coupling located at the proximal end of the first and second members, said first coupling restricting the motions of said members and said coupling whereby said motions are approximately equalized at their common points of contact thereby allowing exchange of acoustic energy between the tubular assemblies above said first coupling and said tubular members below said first coupling;

providing a second coupling placed at the distal end of the first and second members, said second coupling restricting the motions of said members to be equal at their common points of contact thereby allowing exchange of acoustic energy between the tubular assemblies below said second coupling and said tubular members above said second coupling;

providing the lengths, acoustic impedances, and transit times of said tubular members aligned so that by means of constructive and destructive wave interference the acoustic energy transmitted through the upper coupling results in reduced motion and reduced force in the second coupling, and acoustic energy transmitted through the lower coupling results in reduced motion and force in the first coupling whereby downward traveling acoustic energy is selectively reflected upward and upward traveling acoustic energy is selectively reflected downward;

providing the first and second coaxial tubular members comprised of different acoustic structure materials, such that acoustic waves originating at the distal end travelling along said coaxial tubular members travel at substantially different wave speeds;

providing said different acoustic structure materials of equal impedance value; and providing said differing wave speeds inducing a phase difference between said coaxial tubular members, said phase difference depending on the length of the members;

generating acoustic transmitter signals with the BHA;

transmitting acoustic wave signals from the BHA upwardly through said drill string assembly sections; and acoustically filtering said signals with said acoustic isolator by either or both of these steps of filtering or reflecting said acoustic wave signals along said drill string.

18. The method of claim 17, which includes the additional steps of:

combining the waves located in the first tubular member and the second tubular member at the proximal ends of said members;

creating a filter function using the phase difference relative from one coaxial tubular member to the other; and filtering acoustic signals by steering the direction of acoustic waves proximally or distally along said tubular members.

19. The method of claim 17, which includes the additional steps of:

combining the waves located in the first tubular member and the second tubular member at the proximal ends of said members;

creating a filter function using the phase difference relative from one coaxial tubular member to the other; and filtering acoustic signals by isolating the acoustic transmitter signals from otherwise deleterious acoustic noise sources.

20. The method of claim 17, which includes the additional steps of determining the length of a tubular coaxial member of an acoustic isolator to eliminate acoustic interference along the member, which method comprises the steps of:

selecting two different acoustic structure materials of equal impedance;

determining the material mass density (ρi), material stiffness (Ei), and wall area (Ai) of the chosen materials;

determining the appropriate frequency level by plotting the equation:

$$S(f)=|z_2(1-P_1^2)P_2+z_1(1-P_2^2)P_1|$$

determining the length (L) of the members by the equations:

$$L=\frac{1}{2f_r|1/c_1-1/c_2|}$$

$$L=\frac{1}{f_r(1/c_1+1/c_2)}$$

wherein the wave speed (c) and impedance (z) can be calculated by the equations:

$$c_i=\sqrt{E_i/\rho_i}$$

$$z_i=\sqrt{\rho_i E_i}A_i.$$

21. The method of claim 20, including the steps:

using lead for the first different acoustic structure material; and using stainless steel for the second different acoustic structure material.

* * * * *